US010339881B1

(12) United States Patent
Tung

(10) Patent No.: US 10,339,881 B1
(45) Date of Patent: Jul. 2, 2019

(54) METHOD OF ACQUIRING OVERDRIVE LOOK-UP TABLE OF LIQUID CRYSTAL DISPLAY

(71) Applicant: SHENZHEN CHINA STAR OPTOELECTRONICS TECHNOLOGY CO., LTD., Shenzhen, Guangdong (CN)

(72) Inventor: Samar Tung, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 5 days.

(21) Appl. No.: 15/749,029

(22) PCT Filed: Jan. 15, 2018

(86) PCT No.: PCT/CN2018/072550

§ 371 (c)(1),
(2) Date: Jan. 30, 2018

(30) Foreign Application Priority Data

Dec. 28, 2017 (CN) ..... 2017 1 1461313

(51) Int. Cl.
*G09G 3/36* (2006.01)

(52) U.S. Cl.
CPC ..... *G09G 3/3607* (2013.01); *G09G 2310/027* (2013.01); *G09G 2310/0243* (2013.01)

(58) Field of Classification Search
CPC ..... G09G 3/3607; G09G 2310/027; G09G 2310/0243
See application file for complete search history.

(56) References Cited

U.S. PATENT DOCUMENTS 5,339,093 A * 8/1994 Kumagai ..... G01N 21/95607 324/760.01
5,764,209 A * 6/1998 Hawthorne ..... G06F 11/2221 345/87
9,892,674 B2 * 2/2018 Chen ..... G09G 3/2003
2004/0263450 A1 * 12/2004 Lee ..... G09G 3/006 345/87
2005/0125179 A1 * 6/2005 Selby ..... G09G 3/006 702/85
2006/0209095 A1 * 9/2006 Hsu ..... G09G 3/3611 345/690
2007/0176871 A1 * 8/2007 Tsai ..... G09G 3/006 345/89
2008/0204482 A1 * 8/2008 Kim ..... G09G 3/3611 345/690
2009/0153456 A1 * 6/2009 Tsai ..... G09G 3/20 345/89

* cited by examiner

*Primary Examiner* — Mihir K Rayan
(74) *Attorney, Agent, or Firm* — Hauptman Ham, LLP

(57) ABSTRACT

The disclosure provides a method of acquiring an overdrive look-up table of a liquid crystal display. By measuring a plurality of chromaticities in the central area and the edge area of each of the test pictures respectively, a plurality of compliance data is found, and a median of the compliance data is taken as an overdriving value, and then an overdrive look-up table is generated according to the overdriving values acquired from the test, the method can automatically acquire the overdrive look-up table of LCD, thereby improving test efficiency and reducing test costs.

16 Claims, 1 Drawing Sheet

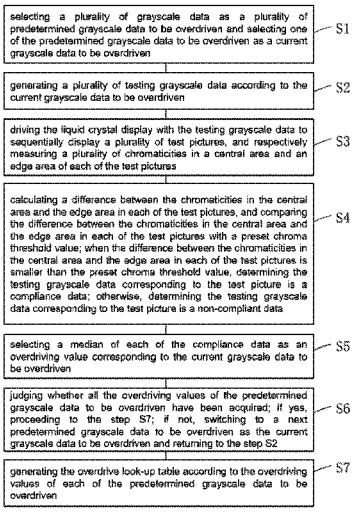

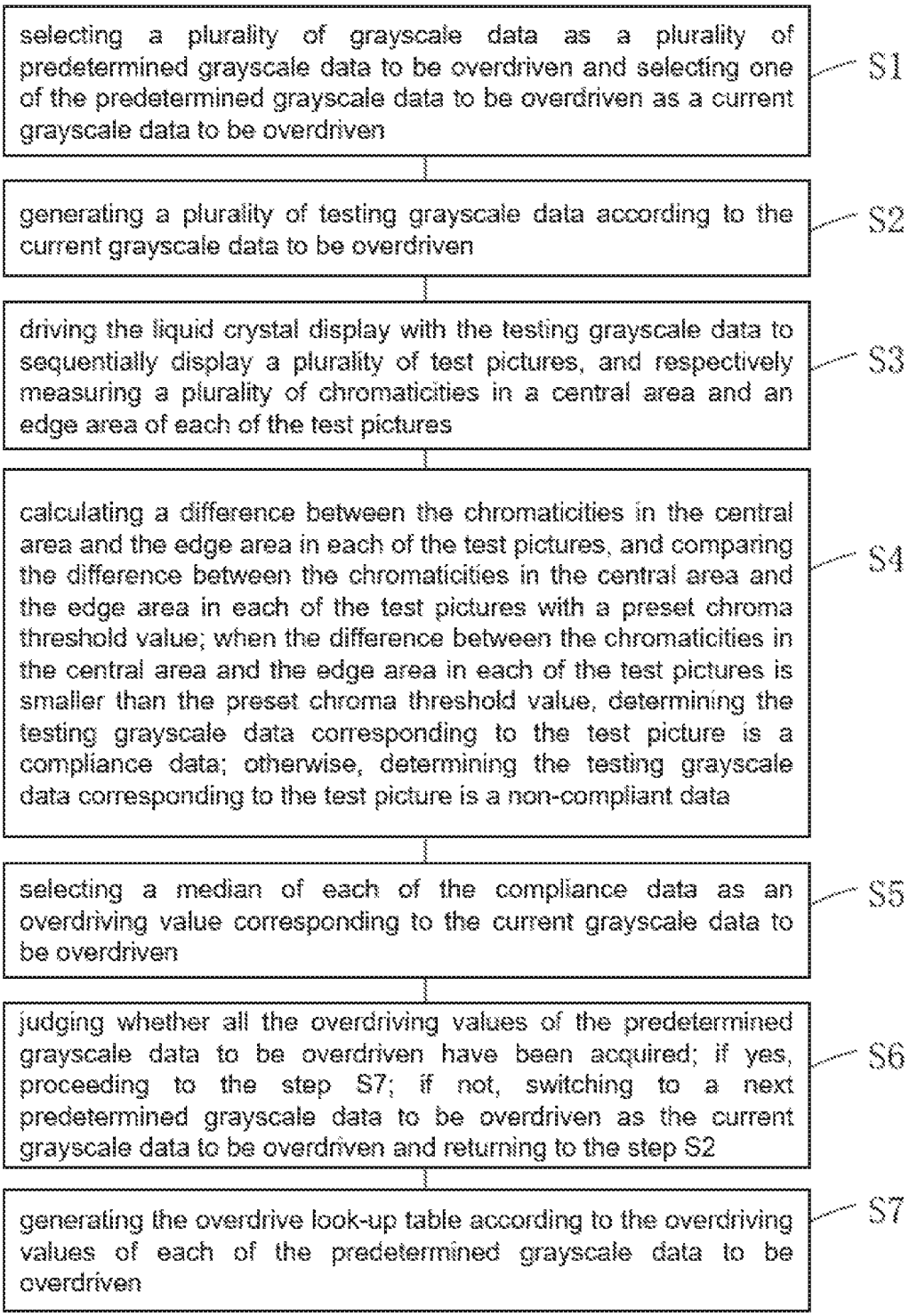
selecting a plurality of grayscale data as a plurality of predetermined grayscale data to be overdriven and selecting one of the predetermined grayscale data to be overdriven as a current grayscale data to be overdriven
S1
generating a plurality of testing grayscale data according to the current grayscale data to be overdriven
S2
driving the liquid crystal display with the testing grayscale data to sequentially display a plurality of test pictures, and respectively measuring a plurality of chromaticities in a central area and an edge area of each of the test pictures
S3
calculating a difference between the chromaticities in the central area and the edge area in each of the test pictures, and comparing the difference between the chromaticities in the central area and the edge area in each of the test pictures with a preset chroma threshold value; when the difference between the chromaticities in the central area and the edge area in each of the test pictures is smaller than the preset chroma threshold value, determining the testing grayscale data corresponding to the test picture is a compliance data; otherwise, determining the testing grayscale data corresponding to the test picture is a non-compliant data
S4
selecting a median of each of the compliance data as an overdriving value corresponding to the current grayscale data to be overdriven
S5
judging whether all the overdriving values of the predetermined grayscale data to be overdriven have been acquired; if yes, proceeding to the step S7; if not, switching to a next predetermined grayscale data to be overdriven as the current grayscale data to be overdriven and returning to the step S2
S6
generating the overdrive look-up table according to the overdriving values of each of the predetermined grayscale data to be overdriven
S7

METHOD OF ACQUIRING OVERDRIVE LOOK-UP TABLE OF LIQUID CRYSTAL DISPLAY

RELATED APPLICATIONS

The present application is a National Phase of International Application Number PCT/CN2018/072550, filed on Jan. 15, 2018, and claims the priority of China Application No. 201711461313.7, filed on Dec. 28, 2017.

FIELD OF THE DISCLOSURE

The disclosure relates to the field of display technology, and in particular to a method of acquiring an overdrive look-up table of a liquid crystal display.

BACKGROUND

With the development of display technologies, flat display apparatus such as liquid crystal display (LCD) has been widely used in consumer electronics products such as mobile phones, televisions, personal digital assistants, digital cameras, laptops, and desktop computers, and has become the mainstream of display devices because of its advantages such as high quality, power saving, thin body, and wide application.

Most of the conventional LCD device on the market are backlight LCD, which includes a LCD panel and a backlight module. The working principle of the LCD panel is to place the liquid crystal molecules in two parallel glass substrates and to control the liquid crystal molecules to change directions by energizing or not, so as to refract the light of the backlight module to generate a picture.

In the process of driving the LCD panel, due to the limited response speed of the liquid crystal, it is difficult to reach the expected deflection angle in a short period of time, thereby causing color shift to affect the display effect. To overcome the defects, an overdrive (OD) technology is proposed in the prior art, so as to make the liquid crystal reach the expected deflection target in a relatively short period of time. The principle of the OD technology is that when the current grayscale is needed to be switched to the target grayscale, if only the driving voltage of the target grayscale is applied, due to the slow response of the liquid crystal flip, the target grayscale cannot be achieved in actuality. However, when using the OD technology, the driving voltage corresponding to the OD grayscale having a larger difference from the driving voltage corresponding to the current grayscale is provided, so as to speed up the flip speed of the liquid crystal to achieve the target grayscale in actual need, thereby solving the problem of color shift.

In order to achieve overdriving, an overdrive look-up table needs to be preset. The abscissa and ordinate of the overdrive look-up table are respectively the current grayscale and the target grayscale, so that the OD grayscale can be found according to the current grayscale and the target grayscale from the overdrive look-up table, and then a drive voltage corresponding to the OD grayscale drives the liquid crystal to flip so as to achieve overdriving; in the prior art, an overdrive look-up table is acquired by performing a debugging test on a liquid crystal display panel by using a manual method, which is inefficient and has a high labor cost.

SUMMARY

An object of the disclosure is to provide a method of acquiring an overdrive look-up table of a liquid crystal display, which can automatically acquire an overdrive look-up table of the liquid crystal display to improve the testing efficiency and reduce the testing cost.

In order to achieve the object, the disclosure provides a method of acquiring an overdrive look-up table of a liquid crystal display, including the following steps:

step S1: selecting a plurality of grayscale data as a plurality of predetermined grayscale data to be overdriven, and selecting one of the predetermined grayscale data to be overdriven as a current grayscale data to be overdriven;

step S2: generating a plurality of testing grayscale data according to the current grayscale data to be overdriven;

step S3: driving the liquid crystal display with the testing grayscale data to sequentially display a plurality of test pictures, and respectively measuring chromaticities in a central area and an edge area of each of the test pictures;

step S4: calculating a difference between the chromaticities in the central area and the edge area in each of the test pictures, and comparing the difference between the chromaticities in the central area and the edge area in each of the test pictures with a preset chroma threshold value; when the difference between the chromaticities in the central area and the edge area in each of the test pictures is smaller than the preset chroma threshold value, determining the testing grayscale data corresponding to the test picture is compliance data; otherwise, determining the testing grayscale data corresponding to the test picture is a non-compliant data;

step S5: selecting a median of each of the compliance data as an overdriving value corresponding to the current grayscale data to be overdriven;

step S6: judging whether the number L of the overdriving values of the predetermined grayscale data to be overdriven have been acquired; if yes, proceeding to the step S7; if not, switching to next predetermined grayscale data to be overdriven as the current grayscale data to be overdriven and returning to the step S2; and Step S7: generating the overdrive look-up table according to the overdriving values of each of the predetermined grayscale data to be overdriven.

In the step S1, each of the grayscale data includes a first grayscale value, a second grayscale value, and a third grayscale value.

the first grayscale value of each of the predetermined grayscale data to be overdriven selected in the step S1 is equal to a positive integral multiple of a preset driving amplitude or equal to a maximum grayscale value, the second grayscale value is equal to the first grayscale value, the third grayscale value is less than the first grayscale value, and when the first grayscale value is equal to the positive integral multiple of the preset driving amplitude, the third grayscale value is equal to an integral multiple of the preset driving amplitude; when the first grayscale value is equal to the maximum grayscale value, the third grayscale value is equal to an even multiple of the preset driving amplitude, and the preset driving amplitude is a positive integer.

In the step S2, when the third grayscale value of the current grayscale data to be overdriven is a minimum grayscale value, acquiring a number L of the testing grayscale data according to Formula 1;

$$Ma=M+a;$$

$$Na=N;$$

$$Ka=K; \qquad \text{Formula 1:}$$

where M, N, and K are the first grayscale value, the second grayscale value, and the third grayscale value of the predetermined grayscale data to be overdriven; Ma, Na, and Ka are the first grayscale value, the second grayscale value, and the third grayscale value of an a-th testing grayscale data, a is a positive integer less than or equal to L, and L is twice the preset driving amplitude;

when the first grayscale value of the current grayscale data to be overdriven is a maximum grayscale value, generating a number L of the testing grayscale data according to Formula 2;

$$Ma=M;$$

$$Na=N;$$

$$Ka=K-a; \quad \text{Formula 2:}$$

when the first grayscale value of the current grayscale data to be overdriven is not the maximum grayscale value and the third grayscale value thereof is not the minimum grayscale value, generating G rows and G columns of the grayscale values to be tested according to Formula 3;

$$M_{(i,j)}=M+i;$$

$$N_{(i,j)}=N;$$

$$K_{(i,j)}=K-j;$$

$M_{(i,j)}$, $N_{(i,j)}$ and $K_{(i,j)}$ is the first grayscale value, the second grayscale value, and the third grayscale value of an i-th row and j-th column of the testing grayscale data, i and j are positive integers less than or equal to G, and G is equal to the preset driving amplitude.

The step S5 further includes: when all the testing grayscale data is the non-compliant data, selecting the testing grayscale data corresponding to one of the test pictures with the difference between the chromaticities in the central area and the edge area in each of the test pictures is closest to the preset chroma threshold value as the overdriving value corresponding to the current grayscale data to be overdriven.

The step S7 specifically includes:

The overdriving values of each of the predetermined grayscale data to be overdriven are filled in the corresponding positions in the overdrive look-up table, and linear interpolation is performed according to the overdriving values of the predetermined grayscale data to be overdriven having been filled to acquire a complete overdrive look-up table.

the step S7 further includes: before performing linear interpolation according to the overdriving values of the predetermined grayscale data to be overdriven filled in the overdrive look-up table, checking and sorting the overdriving values of each of the predetermined grayscale data to be overdriven filled in the overdrive look-up table, finding out the overdriving value not meeting a preset collation, and using a mean value of two of the driving values adjacent to the driving value not meeting the preset collation to replace the driving value not meeting the preset collation.

The overdriving values in the overdrive look-up table are arranged in ascending order of a row direction and a column direction.

The step S5 specifically includes: respectively selecting a median of the first grayscale values and a median of the third grayscale values of the compliance data as a first overdriving value and a second overdriving value corresponding to the current overdriving grayscale data.

The liquid crystal display includes a red sub-pixel, a green sub-pixel, and a blue sub-pixel repeatedly arranged in sequence;

the method of acquiring the overdrive look-up table of the liquid crystal display before the step S7 specifically includes: respectively driving the red sub-pixel, the green sub-pixel, and the blue sub-pixel in the liquid crystal display with the first grayscale value, the second grayscale value, and the third grayscale value of the grayscale data, and completing a first round of the steps S1 to S6 to generate a first set of the overdriving values;

respectively driving the green sub-pixel, the blue sub-pixel, and the red sub-pixel in the liquid crystal display with the second grayscale value, the second grayscale value, and the third grayscale value of the grayscale data, and completing a second round of the steps S1 to S6 to generate a second set of the overdriving values;

respectively driving the blue sub-pixel, the red sub-pixel, and the green sub-pixel in the liquid crystal display with the first grayscale value, the second grayscale value, and the third grayscale value of the grayscale data, and completing a third round of the steps S1 to S6 to generate a third set of the overdriving values;

in the step S7, taking a plurality of average values of the first set, the second set, and a third set of the overdriving values as the overdriving values of each of the predetermined grayscale data to be overdriven, and then generating the overdrive look-up table.

The disclosure further provides a method of acquiring an overdrive look-up table of a liquid crystal display, including the following steps:

step S1: selecting a plurality of grayscale data as a plurality of predetermined grayscale data to be overdriven, and selecting one of the predetermined grayscale data to be overdriven as a current grayscale data to be overdriven;

step S2: generating a plurality of testing grayscale data according to the current grayscale data to be overdriven;

step S3: driving the liquid crystal display with the testing grayscale data to sequentially display a plurality of test pictures; and respectively measuring chromaticities in a central area and an edge area of each of the test pictures;

step S4: calculating a difference between the chromaticities in the central area and the edge area in each of the test pictures, and comparing the difference between the chromaticities in the central area and the edge area in each of the test pictures with a preset chroma threshold value; when the difference between the chromaticities in the central area and the edge area in each of the test pictures is smaller than the preset chroma threshold value; determining the testing grayscale data corresponding to the test picture is compliance data; otherwise, determining the testing grayscale data corresponding to the test pictures is not compliance data;

step S5: selecting a median of each of the compliance data as an overdriving value corresponding to the current grayscale data to be overdriven;

step S6: judging whether all the overdriving values of the predetermined grayscale data to be overdriven have been acquired; if yes, proceeding to the step S7; if not, switching to next predetermined grayscale data to be overdriven as the current grayscale data to be overdriven and returning to the step S2; and step S7: generating the overdrive look-up table according to the overdriving values of each of the predetermined grayscale data to be overdriven;

in the step S1, each of the grayscale data includes a first grayscale value; a second grayscale value; and a third grayscale value.

The first grayscale value of each of the predetermined grayscale data to be overdriven selected in the step S1 is equal to a positive integral multiple of a preset driving amplitude or equal to a maximum grayscale value, the second grayscale value is equal to the first grayscale value, the third grayscale value is less than the first grayscale value, and when the first grayscale value is equal to the positive integral multiple of the preset driving amplitude, the third grayscale value is equal to an integral multiple of the preset driving amplitude; when the first grayscale value is equal to the maximum grayscale value, the third grayscale value is equal to an even multiple of the preset driving amplitude, and the preset driving amplitude is a positive integer;

in the step S2, when the third grayscale value of the current grayscale data to be overdriven is a minimum grayscale value, acquiring a number L of the testing grayscale data according to Formula 1;

$$Ma=M+a;$$

$$Na=N;$$

$$Ka=K; \qquad \text{Formula 1:}$$

where M, N, and K are the first grayscale value, the second grayscale value, and the third grayscale value of the predetermined grayscale data to be overdriven; Ma, Na, and Ka are the first grayscale value, the second grayscale value, and the third grayscale value of an a-th testing grayscale data, a is a positive integer less than or equal to L, and L is twice the preset driving amplitude;

when the first grayscale value of the current grayscale data to be overdriven is a maximum grayscale value, generating a number L of the testing grayscale data according to Formula 2;

$$Ma=M;$$

$$Na=N;$$

$$Ka=K-a; \qquad \text{Formula 2:}$$

when the first grayscale value of the current grayscale data to be overdriven is not the maximum grayscale value and the third grayscale value thereof is not the minimum grayscale value, generating G rows and G columns of the grayscale values to be tested according to Formula 3;

$$M_{(i,j)} \leq M+i;$$

$$N_{(i,j)}=N;$$

$$K_{(i,j)}=K-j;$$

$M_{(i,j)}$, $N_{(i,j)}$ and $K_{(i,j)}$ is the first grayscale value, the second grayscale value and the third grayscale value of an i-th row and j-th column of the testing grayscale data, i and j are positive integers less than or equal to G, and G is equal to the preset driving amplitude;

the step S5 further includes: when all the testing grayscale data is the non-compliant data, selecting the testing grayscale data corresponding to one of the test pictures with the difference between the chromaticities in the central area and the edge area in each of the test pictures is closest to the preset chroma threshold value as the overdriving value corresponding to the current grayscale data to be overdriven.

The beneficial effect of the disclosure is that the disclosure provides a method of acquiring an overdrive look-up table of a liquid crystal display. By measuring the chromaticity in the central area and the edge area of each test pictures respectively, a plurality of compliance data is found, and the median of the compliance data is taken as the overdriving value, and then an overdrive look-up table is generated according to the overdriving value acquired from the test, the method can automatically acquire the overdrive look-up table of LCD, thereby improving test efficiency and reducing test costs.

BRIEF DESCRIPTION OF THE DRAWINGS

For further understanding of the features and technical contents of the disclosure, reference should be made to the following detailed description and accompanying drawings of the disclosure. However, the drawings are for reference only and are not intended to limit the disclosure.

In the drawings,

FIG. 1 is a flowchart of a method of acquiring an overdrive look-up table of a liquid crystal display according to the disclosure.

DETAILED DESCRIPTION OF PREFERRED EMBODIMENTS

In To further illustrate the technical means adopted by the disclosure and the effects thereof, the following describes in detail the preferred embodiments of the disclosure and the accompanying drawings.

Referring to FIG. 1, the disclosure provides a method of acquiring an overdrive look-up table of a liquid crystal display, including the following steps:

step S1: selecting a plurality of grayscale data as a plurality of predetermined grayscale data to be overdriven and selecting a predetermined grayscale data to be overdriven as a current grayscale data to be overdriven.

Specifically, the liquid crystal display includes a plurality of pixel units arranged in an array, each of the pixel units includes a red sub-pixel, a green sub-pixel, and a blue sub-pixel sequentially arranged, the color display is achieved by displaying red, green, and blue respectively through the red sub-pixel, the green sub-pixel, and the blue sub-pixel.

In the embodiment of the disclosure, each grayscale data includes a first grayscale value, a second grayscale value, and a third grayscale value, and the first grayscale value, the second grayscale value, and the third grayscale value are respectively configured to drive one of the red sub-pixel, the green sub-pixel, and the blue sub-pixel, and the different grayscale values drive different sub-pixels.

Specifically, the first grayscale value of each of the predetermined grayscale data to be overdriven selected in the step S1 is equal to a positive integral multiple of a preset driving amplitude or equal to a maximum grayscale value, the second grayscale value is equal to the first grayscale value, the third grayscale value is less than the first grayscale value, and when the first grayscale value is equal to the positive integral multiple of the preset driving amplitude, the third grayscale value is equal to an integral multiple of the preset driving amplitude; when the first grayscale value is equal to the maximum grayscale value, the third grayscale value is equal to an even multiple of the preset driving amplitude, and the preset driving amplitude is a positive integer.

Preferably, the first grayscale value, the second grayscale value, and the third grayscale value have a value range of 0~255, and the preset driving amplitude is 32, so in the embodiment of the disclosure, the predetermined grayscale data to be overdriven selected in the step S1 includes: (32, 32, 0), (64, 64, 0), (64, 64, 32), (96, 96, 0), (96, 96, 32), (96, 96, 64), (128, 128, 0) (128, 128, 32), (128, 128, 64), (128, 128, 96), (160, 160, 0), (160, 160, 32), (160, 160, 64), (160, 160, 96), (160, 160, 128), (192, 192, 0), (192, 192, 32), (192, 192, 64), (192, 192, 96), (192, 192, 128), (192, 192, 160), (224, 224, 0), (224, 224, 32), (224, 224, 64), (224, 224, 96), (224, 224, 128), (224, 224, 160), (224, 224, 192), (255, 255, 64), (255, 255, 128), and (255, 255, 192), where the three data in parentheses are the first grayscale value, the second grayscale value, and the third grayscale value.

The third grayscale values in the predetermined grayscale data to be overdriven of (32, 32, 0), (64, 64, 0), (96, 96, 0), (128, 128, 0), (160, 160, 0), (192, 192, 0), and (224, 224, 0) are all the minimum grayscale value and can no longer be adjusted, only the first grayscale value can be adjusted; and the first grayscale values in (255, 255, 64), (255, 255, 128), and (255, 255, 192) are all the maximum grayscale value and also can no longer be adjusted, only the third grayscale values can be adjusted, and the first grayscale values and the third grayscale values of the others of the predetermined grayscale data to be overdriven remained may be adjusted simultaneously.

Step S2: generating a plurality of testing grayscale data according to the current grayscale data to be overdriven.

Specifically, in the step S2, when the third grayscale value of the current grayscale data to be overdriven is a minimum grayscale value, a number L of the testing grayscale data can be acquired according to Formula 1;

$$Ma=M+a;$$

$$Na=N;$$

$$Ka=K; \qquad \text{Formula 1:}$$

where M, N, and K are the first grayscale value, the second grayscale value, and the third grayscale value of the predetermined grayscale data to be overdriven; Ma, Na, and Ka are the first grayscale value, the second grayscale value, and the third grayscale value of an a-th testing grayscale data, a is a positive integer less than or equal to L, and L is twice the preset driving amplitude;

when the first grayscale value of the current grayscale data to be overdriven is a maximum grayscale value, a number L of the testing grayscale data can be acquired according to Formula 2;

$$Ma=M;$$

$$Na=N;$$

$$Ka=K-a; \qquad \text{Formula 2:}$$

when the first grayscale value of the current grayscale data to be overdriven is not the maximum grayscale value and the third grayscale value thereof is not the minimum grayscale value, generating G rows and G columns of the grayscale values to be tested according to Formula 3;

$$M_{(i,j)}=M+i;$$

$$N_{(i,j)}=N;$$

$$K_{(i,j)}=K-j;$$

$M_{(i,j)}$, $N_{(i,j)}$ and $K_{(i,j)}$ is the first grayscale value, the second and the third grayscale value of an i-th row and j-th column of the testing grayscale data, i and are positive integers less than or equal to G, and G is equal to the preset driving amplitude.

It is to be understood that the first grayscale value, the second grayscale value, and the third grayscale value of the testing grayscale data should all fall within a range of the grayscale values of the liquid crystal display, for example, all in the range of 0~255.

Corresponding to the embodiments, 64 testing grayscale data are respectively generated for the predetermined grayscale data to be overdriven of (32; 32, 0); (64; 64, 0), (96, 96, 0), (128, 128, 0), (160, 160, 0), (192, 192, 0), and (224, 224; 0); taking (32; 32, 0) as an example; the 64 grayscale data are respectively (33,32,0), (34,32,0), (35,32,0), (36,32, 0) and so on until (96,32,0); 64 testing grayscale data are respectively generated for the predetermined grayscale data to be overdriven of (255,255,64), (255,255,128), and (255, 255,192); taking (255, 255, 64) as an example, the 64 grayscale data are (255,255,63); (255,255,62), (255,255,61), (255,255,60) and so on until (255,255,0); 32 times 32, that is, 1024 testing grayscale data are generated for each of remaining predetermined grayscale data to be overdriven, and each of the testing grayscale data satisfies the Formula 3.

Step S3: driving the liquid crystal display with the testing grayscale data to sequentially display a plurality of test pictures and measuring the chromaticity in the central area and the edge area in each of the test pictures respectively.

Specifically, the chromaticity includes an abscissa value X of the chromaticity and an ordinate value Y of the chromaticity.

step S4: calculating a difference between the chromaticities in the central area and the edge area in each of the test pictures, and comparing the difference between the chromaticities in the central area and the edge area in each of the test pictures with a preset chroma threshold value; when the difference between the chromaticities in the central area and the edge area in each of the test pictures is smaller than the preset chroma threshold value, determining the testing grayscale data corresponding to the test pictures is compliance data; otherwise, determining the testing grayscale data corresponding to the test picture is a non-compliant data.

Specifically, the difference between the chromaticities in the central area and the edge area in each of the test pictures includes the difference between the abscissa values X of the chromaticity of the central area and the edge area in each of the test pictures and the ordinate values Y of the chromaticity in the central area and the edge area in each of the test pictures; when the difference between the abscissa value X of the chromaticity in the central area and the edge area in each of the test pictures and the ordinate values Y of the chromaticity in the central area and the edge area in each of the test pictures are less than the preset chroma threshold value, the testing grayscale data corresponding to the test pictures is determined as compliance data, otherwise it is the non-compliant data, for example, a preset chroma threshold is 0.02; at this time, in one of the test pictures, if the difference between the abscissa values X of the chromaticity of the central area and the edge area and the difference between the ordinate values Y of the chromaticity of the central area and the edge area are all less than 0.02, then the testing grayscale data corresponding to the test picture is determined as compliance data.

Step S5: selecting a median of each of the compliance data as an overdriving value corresponding to the current grayscale data to be overdriven.

In specific implementation, the median of the first grayscale values and the median of the third grayscale values of each of the compliance data are respectively selected as the first overdriving value and the second overdriving value corresponding to the current grayscale data to be overdriven; for example, the medians of the first grayscale value and the second grayscale value of the compliance data in each of the grayscale data generated by the predetermined grayscale data to be overdriven (64; 64, 32) are respectively 78 and 15, then the first overdriving value and the second overdriving value corresponding to the predetermined grayscale data to be overdriven (64, 64, 32) are respectively 78 and 15; when corresponding to the overdrive look-up table, 78 is the overdriving value when the current grayscale value is 32 and the target grayscale value is 64, 15 is the overdriving value when the current grayscale value is 64 and the target grayscale value is 32, that is, the first overdriving value is filled in a position of the overdrive look-up table where the current grayscale value is the third grayscale value of the current grayscale data to be overdriven, and the target grayscale value is the first grayscale value of the current grayscale data to be overdriven. And the second overdriving value is filled in a position of the overdrive look-up table where the current grayscale value is the first grayscale value of the current grayscale data to be overdriven, and the target grayscale value is the third grayscale value of the current grayscale data to be overdriven.

It should be understood that when all the testing grayscale data are the non-compliant data, the testing grayscale data corresponding to the test picture where the difference of the chromaticity between the central area and the edge area closest to the preset chroma threshold value is selected as the overdriving value corresponding to the current grayscale data to be overdriven; and the test picture where the difference of the chromaticities between the central area and the edge area closest to the preset chroma threshold value is the test picture where both the difference between the abscissa values X of the chromaticity of the central area and the edge area and the difference between the ordinate values Y of the chromaticity in the central area and the edge area closest to the preset chroma threshold value.

Step S6: judging whether all the overdriving values of the predetermined grayscale data to be overdriven have been acquired; if yes, proceeding to the step S7; if not, switching to next predetermined grayscale data to be overdriven as the current grayscale data to be overdriven and returning to the step S2; and Step S7: generating the overdrive look-up table according to the overdriving values of each of the predetermined grayscale data to be overdriven.

Specifically, the step S7 specifically includes:

filling the overdriving values of each of the predetermined grayscale data to be overdriven in corresponding positions in the overdrive look-up table and performing linear interpolation according to the overdriving values of the predetermined grayscale data to be overdriven filled in the overdrive look-up table to generate a complete overdrive look-up table.

Further, the step S7 further includes: before performing linear interpolation according to the overdriving values of the predetermined grayscale data to be overdriven filled in the overdrive look-up table, checking and sorting the overdriving values of each of the predetermined grayscale data to be overdriven filled in the overdrive look-up table, finding out the overdriving value not meeting a preset collation, and using a mean value of two of the driving values adjacent to the driving value not meeting the preset collation to replace the driving value not meeting the preset collation, and the overdriving values in the overdrive look-up table are arranged in ascending order of a row direction and a column direction.

In specific implementation, in order to make the data in an overdrive look-up table adapt to the driving of sub-pixels of three different colors at the same time, the disclosure further includes before step S7: at first, based on the red sub-pixel, the green sub-pixel and the blue sub-pixel in the liquid crystal display being respectively driven by the first grayscale value, the second grayscale value, and the third grayscale value of the grayscale data, completing a first round of the steps S1 to S6 to generate a first set of the overdriving values; second, based on the green sub-pixel; the blue sub-pixel, and the red sub-pixel in the liquid crystal display being respectively driven by the first grayscale value, the second grayscale value, and the third grayscale value of the grayscale data, completing a second round of the steps S1 to S6 to generate a second set of the overdriving values; finally, based on the blue sub-pixel, the red sub-pixel, and the green sub-pixel in the liquid crystal display being respectively driven by the first grayscale value, the second grayscale value, and the third grayscale value of the grayscale data, completing a third round of the steps S1 to S6 to generate a third set of the overdriving values;

Finally, in the step S7, a plurality of average values of the first set, the second set, and a third set of the overdriving values is taken as the overdriving values of each of the predetermined grayscale data to be overdriven; and then an overdrive look-up table is generated. For example; in the first set of the overdriving values, the overdriving value is 78 when the current grayscale data is 32 and the target grayscale data is 64; in the second set of the overdriving values, the overdriving value is 77 when the current grayscale data is 32 and the target grayscale data is 64; in the second set of the overdriving values, the overdriving value is 76 when the current grayscale data is 32 and the target grayscale data is 64; then the overdriving value filled in the overdrive look-up table when the current grayscale data is 32 and the target grayscale data is 64 is (78+77+76)/3, that is, equal to 77.

In summary, the disclosure provides a method of acquiring an overdrive look-up table of a liquid crystal display. By measuring the chromaticities in the central area and the edge area of each of the test pictures respectively, a plurality of compliance data is found, and the median of the compliance data is taken as the overdriving value, and then an overdrive look-up table is generated according to the overdriving value acquired from the test, the method can automatically acquire the overdrive look-up table of LCD, thereby improving test efficiency and reducing test costs.

As described above, it will be apparent to those skilled in the art that various other changes and modifications may be made in accordance with the technical solutions and technical concepts of the disclosure, and all such changes and modifications are subject to be included in the scope of protection of the appended claims.

What is claimed is:

1. A method of acquiring an overdrive look-up table of a liquid crystal display, comprising the following steps:

step S1: selecting a plurality of grayscale data as a plurality of predetermined grayscale data to be overdriven, and selecting one of the predetermined grayscale data to be overdriven as a current grayscale data to be overdriven;

step S2: generating a plurality of testing grayscale data according to the current grayscale data to be overdriven;

step S3: driving the liquid crystal display with the testing grayscale data to sequentially display a plurality of test pictures, and respectively measuring a plurality of chromaticities in a central area and an edge area of each of the test pictures;

step S4: calculating a difference between the chromaticities in the central area and the edge area in each of the test pictures, and comparing the difference between the chromaticities in the central area and the edge area in each of the test pictures with a preset chroma threshold value; when the difference between the chromaticities in the central area and the edge area in each of the test pictures is smaller than the preset chroma threshold value, determining the testing grayscale data corresponding to the test picture is a compliance data; otherwise, determining the testing grayscale data corresponding to the test picture is a non-compliant data;

step S5: selecting a median of each of the compliance data as an overdriving value corresponding to the current grayscale data to be overdriven;

step S6: judging whether all the overdriving values of the predetermined grayscale data to be overdriven have been acquired; if yes, proceeding to the step S7; if not, switching to a next predetermined grayscale data to be overdriven as the current grayscale data to be overdriven and returning to the step S2; and step S7: generating the overdrive look-up table according to the overdriving values of each of the predetermined grayscale data to be overdriven.

2. The method of acquiring an overdrive look-up table of a liquid crystal display of claim 1, wherein in the step S1, each of the grayscale data comprises a first grayscale value, a second grayscale value, and a third grayscale value.

3. The method of acquiring an overdrive look-up table of a liquid crystal display according to claim 2, wherein the first grayscale value of each of the predetermined grayscale data to be overdriven selected in the step S1 is equal to a positive integral multiple of a preset driving amplitude or equal to a maximum grayscale value, the second grayscale value is equal to the first grayscale value, the third grayscale value is less than the first grayscale value, and when the first grayscale value is equal to the positive integral multiple of the preset driving amplitude, the third grayscale value is equal to an integral multiple of the preset driving amplitude; when the first grayscale value is equal to the maximum grayscale value, the third grayscale value is equal to an even multiple of the preset driving amplitude, and the preset driving amplitude is a positive integer.

4. The method of acquiring an overdrive look-up table of a liquid crystal display according to claim 3, wherein in the step S2, when the third grayscale value of the current grayscale data to be overdriven is a minimum grayscale value, acquiring a number L of the testing grayscale data according to Formula 1;

$$Ma=M+a;$$

$$Na=N;$$

$$Ka=K; \qquad \text{Formula 1:}$$

wherein M, N, and K are the first grayscale value, the second grayscale value, and the third grayscale value of the predetermined grayscale data to be overdriven; Ma, Na, and Ka are the first grayscale value, the second grayscale value, and the third grayscale value of an a-th testing grayscale data, a is a positive integer less than or equal to L, and L is twice the preset driving amplitude;

when the first grayscale value of the current grayscale data to be overdriven is a maximum grayscale value, generating a number L of the testing grayscale data according to Formula 2;

$$Ma=M;$$

$$Na=N;$$

$$Ka=K-a; \qquad \text{Formula 2:}$$

when the first grayscale value of the current grayscale data to be overdriven is not the maximum grayscale value and the third grayscale value thereof is not the minimum grayscale value, generating G rows and G columns of the grayscale values to be tested according to Formula 3;

$$M_{(i,j)}=M+i;$$

$$N_{(i,j)}=N;$$

$$K_{(i,j)}=K-j;$$

wherein $M_{(i,j)}$, $N_{(i,j)}$ and $K_{(i,j)}$ is the first grayscale value, the second and the third grayscale value of an i-th row and j-th column of the testing grayscale data, i and j are positive integers less than or equal to G, and G is equal to the preset driving amplitude.

5. The method of acquiring an overdrive look-up table of a liquid crystal display according to claim 1, wherein the step S5 further comprises: when all the testing grayscale data is the non-compliant data, selecting the testing grayscale data corresponding to one of the test pictures with the difference between the chromaticities in the central area and the edge area in each of the test pictures is closest to the preset chroma threshold value as the overdriving value corresponding to the current grayscale data to be overdriven.

6. The method of acquiring an overdrive look-up table of a liquid crystal display according to claim 1, wherein the step S7 specifically comprises:

filling the overdriving values of each of the predetermined grayscale data to be overdriven in corresponding positions in the overdrive look-up table and performing linear interpolation according to the overdriving values of the predetermined grayscale data to be overdriven filled in the overdrive look-up table to acquire a complete overdrive look-up table.

7. The method of acquiring an overdrive look-up table of a liquid crystal display according to claim 6, wherein the step S7 further comprises: before performing linear interpolation according to the overdriving values of the predetermined grayscale data to be overdriven filled in the overdrive look-up table, checking and sorting the overdriving values of each of the predetermined grayscale data to be overdriven filled in the overdrive look-up table, finding out the overdriving value not meeting a preset collation, and using a mean value of two of the driving values adjacent to the driving value not meeting the preset collation to replace the driving value not meeting the preset collation.

8. The method of acquiring an overdrive look-up table of a liquid crystal display according to claim 7, wherein the overdriving values in the overdrive look-up table are arranged in ascending order of a row direction and a column direction.

9. The method of acquiring an overdrive look-up table of a liquid crystal display according to claim 4, wherein the step S4 specifically comprises: respectively selecting a median of the first grayscale values and a median of the third grayscale values of the compliance data as a first overdriving value and a second overdriving value corresponding to the current overdriving grayscale data.

10. The method of acquiring an overdrive look-up table of a liquid crystal display according to claim 4, wherein the liquid crystal display comprises a red sub-pixel, a green sub-pixel, and a blue sub-pixel repeatedly arranged in sequence;

the method of acquiring an overdrive look-up table of a liquid crystal display before the step S7 specifically comprises: respectively driving the red sub-pixel, the green sub-pixel, and the blue sub-pixel in the liquid crystal display with the first grayscale value, the second grayscale value, and the third grayscale value of the grayscale data, and completing a first round of the steps S1 to S6 to generate a first set of the overdriving values;

respectively driving the green sub-pixel, the blue sub-pixel, and the red sub-pixel in the liquid crystal display with the first grayscale value, the second grayscale value, and the third grayscale value of the grayscale data, and completing a second round of the steps S1 to S6 to generate a second set of the overdriving values;

respectively driving the blue sub-pixel, the red sub-pixel, and the green sub-pixel in the liquid crystal display with the first grayscale value, the second grayscale value, and the third grayscale value of the grayscale data, and completing a third round of the steps S1 to S6 to generate a third set of the overdriving values;

wherein in the step S7, a plurality of average values of the first set, the second set, and the third set of the overdriving values is taken as the overdriving values of each of the predetermined grayscale data to be overdriven, and then the overdrive look-up table is generated.

11. A method of acquiring an overdrive look-up table of a liquid crystal display, comprising the following steps:

step S1: selecting a plurality of grayscale data as a plurality of predetermined grayscale data to be overdriven, and selecting one of the predetermined grayscale data to be overdriven as a current grayscale data to be overdriven;

step S2: generating a plurality of testing grayscale data according to the current grayscale data to be overdriven;

step S3: driving the liquid crystal display with the testing grayscale data to sequentially display a plurality of test pictures, and respectively measuring a plurality of chromaticities in a central area and an edge area of each of the test pictures;

step S4: calculating a difference between the chromaticities in the central area and the edge area in each of the test pictures; and comparing the difference between the chromaticities in the central area and the edge area in each of the test pictures with a preset chroma threshold value; when the difference between the chromaticities in the central area and the edge area in each of the test pictures is smaller than the preset chroma threshold value, determining the testing grayscale data corresponding to the test picture is a compliance data; otherwise, determining the testing grayscale data corresponding to the test picture is a non-compliant data;

step S5: selecting a median of each of the compliance data as an overdriving value corresponding to the current grayscale data to be overdriven;

step S6: judging whether all the overdriving values of the predetermined grayscale data to be overdriven have been acquired; if yes, proceeding to the step S7; if not, switching to next predetermined grayscale data to be overdriven as the current grayscale data to be overdriven and returning to the step S2; and step S7: generating the overdrive look-up table according to the overdriving values of each of the predetermined grayscale data to be overdriven;

in the step S1, each of the grayscale data comprises a first grayscale value, a second grayscale value, and a third grayscale value;

wherein the first grayscale value of each of the predetermined grayscale data to be overdriven selected in the step S1 is equal to a positive integral multiple of a preset driving amplitude or equal to a maximum grayscale value, the second grayscale value is equal to the first grayscale value, the third grayscale value is less than the first grayscale value, and when the first grayscale value is equal to the positive integral multiple of the preset driving amplitude, the third grayscale value is equal to an integral multiple of the preset driving amplitude; when the first grayscale value is equal to the maximum grayscale value, the third grayscale value is equal to an even multiple of the preset driving amplitude, and the preset driving amplitude is a positive integer;

wherein in the step S2, when the third grayscale value of the current grayscale data to be overdriven is a minimum grayscale value, acquiring a number L of the testing grayscale data according to Formula 1;

$$Ma=M+a;$$

$$Na=N;$$

$$Ka=K; \qquad \text{Formula 1:}$$

wherein M, N, and K are the first grayscale value, the second grayscale value, and the third grayscale value of the predetermined grayscale data to be overdriven; Ma, Na, and Ka are the first grayscale value, the second grayscale value, and the third grayscale value of an a-th testing grayscale data, a is a positive integer less than or equal to L, and L is twice the preset driving amplitude;

when the first grayscale value of the current grayscale data to be overdriven is a maximum grayscale value, generating a number L of the testing grayscale data according to Formula 2;

$$Ma=M;$$

$$Na=N;$$

$$Ka=K-a; \qquad \text{Formula 2:}$$

when the first grayscale value of the current grayscale data to be overdriven is not the maximum grayscale value and the third grayscale value thereof is not the minimum grayscale value, generating G rows and G columns of the grayscale values to be tested according to Formula 3;

$$M_{(i,j)}=M+i;$$

$$N_{(i,j)}=N;$$

$$K_{(i,j)}=K-j;$$

wherein $M_{(i,j)}$, $N_{(i,j)}$ and $K_{(i,j)}$ is the first grayscale value, the second grayscale value, and the third grayscale value of an i-th row j-th column of the testing grayscale data, i and j are positive integers less than or equal to G, and G is equal to the preset driving amplitude;

wherein the step S5 further comprises: when all the testing grayscale data is the non-compliant data; selecting the testing grayscale data corresponding to one of the test pictures with the difference between the chromaticities in the central area and the edge area in each of the test pictures is closest to the preset chroma threshold value as the overdriving value corresponding to the current grayscale data to be overdriven.

12. The method of acquiring an overdrive look-up table of a liquid crystal display according to claim 11, wherein the step S7 specifically comprises:

filling the overdriving values of each of the predetermined grayscale data to be overdriven in corresponding positions in the overdrive look-up table and performing linear interpolation according to the overdriving values of the predetermined grayscale data to be overdriven filled in the overdrive look-up table to acquire a complete overdrive look-up table.

13. The method of acquiring an overdrive look-up table of a liquid crystal display according to claim 12, wherein the step S7 further comprises: before performing linear interpolation according to the driving values of the predetermined grayscale data to be overdriven filled in the overdrive look-up table, finding out the overdriving value not meeting a preset collation, and using a mean value of two of the driving values adjacent to the driving value not meeting the preset collation to replace the driving value not meeting the preset collation.

14. The method of acquiring an overdrive look-up table of a liquid crystal display according to claim 13, wherein the overdriving values in the overdrive look-up table are arranged in ascending order of a row direction and a column direction.

15. The method of acquiring an overdrive look-up table of a liquid crystal display according to claim 11, wherein the step S5 specifically comprises: respectively selecting a median of the first grayscale values and a median of the third grayscale values of the compliance data as a first overdriving value and a second overdriving value corresponding to the current overdriving grayscale data.

16. The method of acquiring an overdrive look-up table of a liquid crystal display according to claim 11, wherein the liquid crystal display comprises a red sub-pixel, a green sub-pixel, and a blue sub-pixel repeatedly arranged in sequence;

the method of acquiring the overdrive look-up table of the liquid crystal display before the step S7 specifically comprises: respectively driving the red sub-pixel, the green sub-pixel, and the blue sub-pixel in the liquid crystal display with the first grayscale value, the second grayscale value, and the third grayscale value of the grayscale data, and completing a first round of the steps S1 to S6 to generate a first set of the overdriving values;

respectively driving the green sub-pixel, the blue sub-pixel, and the red sub-pixel in the liquid crystal display with the first grayscale value, the second grayscale value, and the third grayscale value of the grayscale data, and completing a second round of the steps S1 to S6 to generate a second set of the overdriving values;

respectively driving the blue sub-pixel, the red sub-pixel, and the green sub-pixel in the liquid crystal display with the first grayscale value, the second grayscale value, and the third grayscale value of the grayscale data, and completing a third round of the steps S1 to S6 to generate a third set of the overdriving values;

wherein in the step S7, a plurality of average values of the first set, the second set, and the third set of the overdriving values is taken as the overdriving values of each of the predetermined grayscale data to be overdriven, and then the overdrive look-up table is generated.

* * * * *